US005319940A

United States Patent [19]

Yakaski

[11] Patent Number: 5,319,940

[45] Date of Patent: Jun. 14, 1994

[54] DEFROSTING METHOD AND APPARATUS FOR A REFRIGERATION SYSTEM

[76] Inventor: Robert Yakaski, 125 First St., Hudson, Pa. 18705

[21] Appl. No.: 65,474

[22] Filed: May 24, 1993

[51] Int. Cl.[5] ..... F25D 21/06

[52] U.S. Cl. ..... 62/81; 62/151; 62/196.4; 62/278

[58] Field of Search ..... 62/151, 196.4, 81, 277, 62/278, 511, 197, 203, 208

[56] References Cited

U.S. PATENT DOCUMENTS 2,693,678 11/1954 Toothman ..... 62/278
2,770,104 11/1956 Sweynor ..... 62/278
4,802,339 2/1989 Gregory ..... 62/196.4
5,197,297 3/1993 Brendel et al. ..... 62/81

*Primary Examiner*—Harry B. Tanner

*Attorney, Agent, or Firm*—Michael J. Delaney

[57] ABSTRACT

Method and apparatus to defrost evaporator coils of a refrigeration system by periodically replacing the refrigerant in the evaporator coils by hot refrigerant gas from the compression side of a compressor. The gas from the compressor is sent through an oil separator, then through a solenoid valve to a vaporizer tank. From the vaporizer tank, a portion of the hot gas is fed constantly during the defrosting cycle through a metering flow control valve to the evaporator coils. As the pressure builds up in the vaporizer tank due to the compressor supplying more gas than the amount flowing through the metering flow control valve, a pressure control senses the pressure increase and opens a vaporizer solenoid valve to allow additional hot gas to flow to the evaporator coils. In the evaporator the gas heats the evaporator coils and melts the frost on the coils and then passes to the suction line of the compressor.

4 Claims, 2 Drawing Sheets

DEFROSTING METHOD AND APPARATUS FOR A REFRIGERATION SYSTEM

BACKGROUND OF THE INVENTION

The present invention relates to a method and apparatus for defrosting a refrigeration system and in particular defrosting a refrigeration system by passing hot gases from a compressor to the evaporator of the refrigeration system.

SUMMARY OF THE INVENTION

It is an object of this invention to provide a defrosting method and apparatus which defrosts in minimum time without excess temperature rise in the evaporator.

It is another object of this invention to provide a defrosting method and apparatus which allows the system to return to full refrigerating capacity in a minimum amount of time.

It is still another object of this invention to provide a defrosting method and apparatus which can operate satisfactorily and efficiently in low ambient temperatures.

It is also an object of this invention to provide a defrosting method and apparatus which assists in keeping compressor motor loads and compression ratios to satisfactory levels and thus reduce compressor problems and extend compressor life.

The above objects can be attained by this invention by providing a method and apparatus for defrosting an evaporator of a refrigeration system by hot gas supplied by a compressor, and passed through an oil separator to a solenoid valve and then to a vaporizer tank. From the vaporizer tank the hot gas flow is spilt. One portion flows continuously through a bypass metering flow control valve. Another portion flows through a vaporizer solenoid valve which opens to allow such flow when the pressure of the hot gas reaches a set point in the line leading to the vaporizer tank. The two portions of hot gas are then passed to the evaporator coils to defrost the coils and then pass to the suction line of the compressor.

DETAILED DESCRIPTION OF THE DRAWINGS

Figure 1:
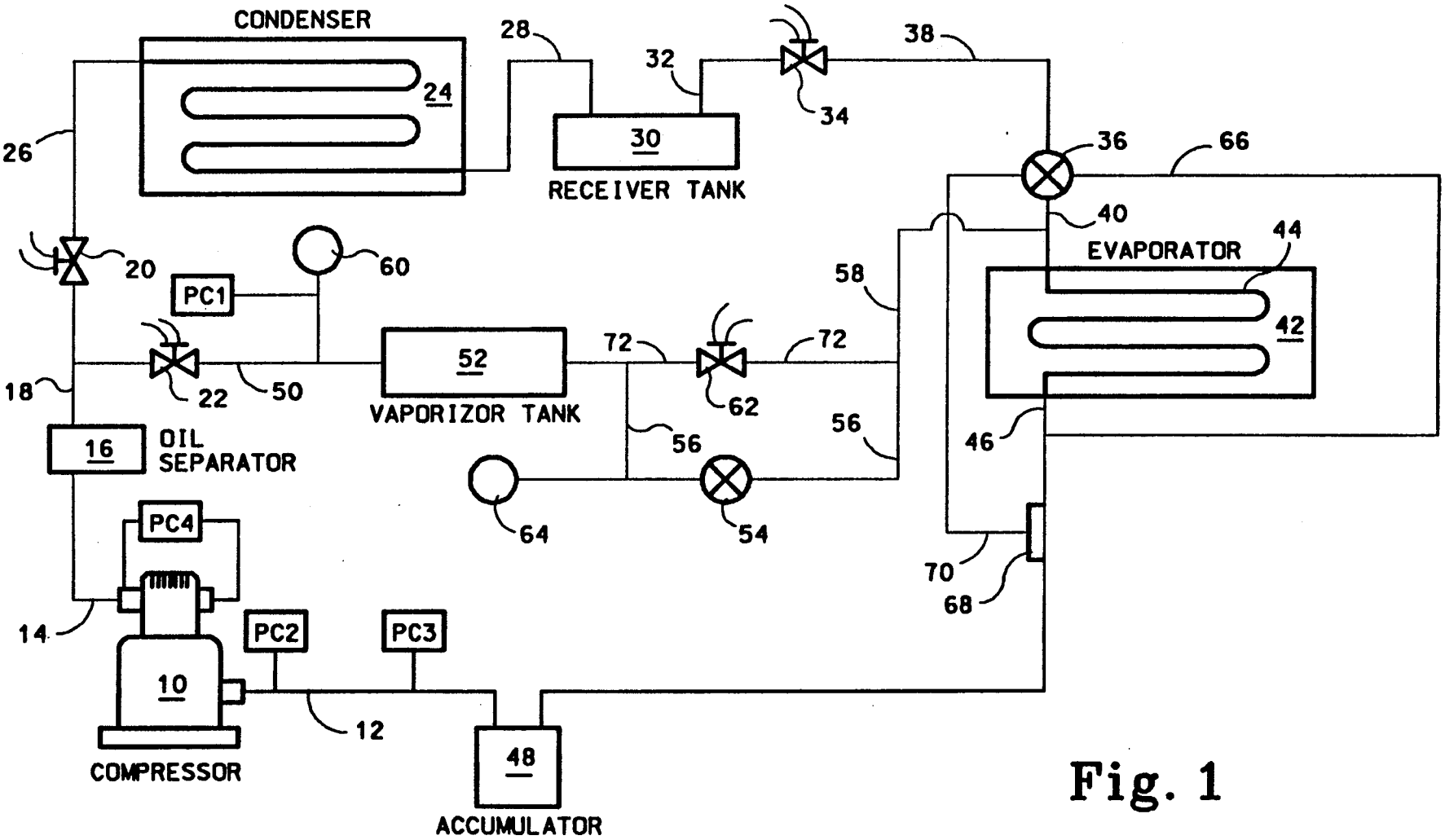
FIG. 1 is a line diagram of the cooling and defrosting cycles of this invention.
Figures 2, 3, 4:
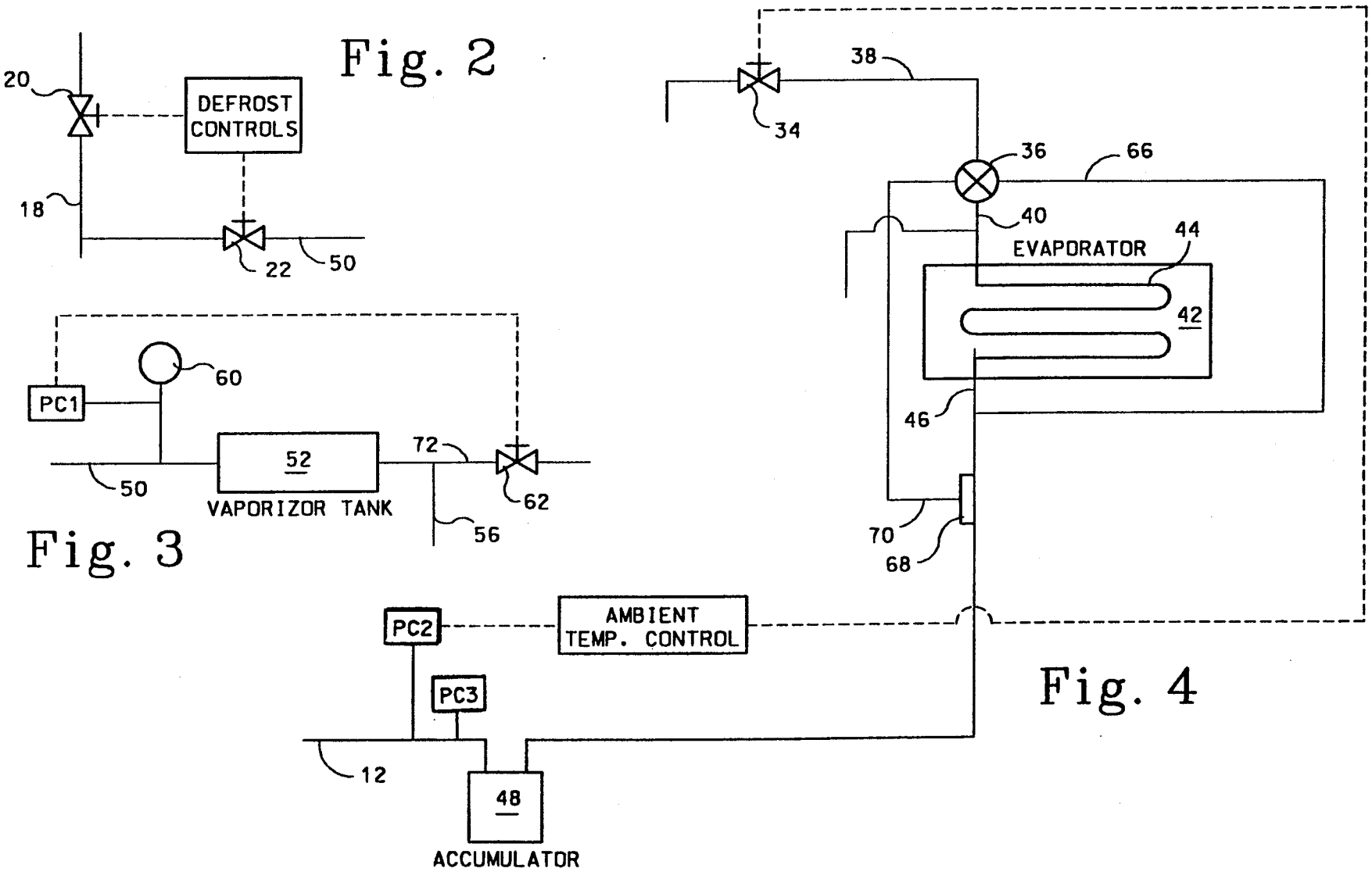
FIG. 2 is a line diagram of the defrost controls portion of this invention.
FIG. 3 is a line diagram of the control means which allows additional hot gas to flow to the evaporator coils.
FIG. 4 is a line diagram of the control means which allows refrigerant to flow to the evaporator coils during defrosting of the coils.

Referring to FIG. 1 and describing the cooling cycle of the refrigeration system, the numeral 10 refers to compressor having a suction or inlet line 13 and a compression or discharge line 14. From the compressor 10, high pressure hot gas enters line 14 and passes through an oil separator where any oil in the gas is removed in a manner well known in the art. The high pressure gas then passes through line 18 through solenoid valve 30 since during the cooling cycle solenoid valve 33 is closed. Referring to FIG. 2, defrost controls operate to close solenoid valve 22 and open solenoid valve 20 during the cooling cycle and to close solenoid valve 20 and open solenoid valve 22 during the defrosting cycle. From solenoid valve 20 of FIG. 1 the compressed gas is fed to a condenser 24 through line 26 where the compressed gas condenses to a high pressure liquid and then passes through line 28 to a receiver tank 30.From receiver tank 30 high pressure liquid passes through line32 and solenoid valve 34 to thermostatic expansion valve 36by way of line 38. The thermostatic expansion valve 36 meters the flow and reduces the pressure of the high pressure liquid refrigerant. The liquid refrigerant then passes by way of line 40 to evaporator coils 44 of evaporator 42. In the evaporator coils 44, high pressure liquid changes to low pressure vapors thereby cooling the evaporator coils 44. Air is passed about about the evaporator coils 44 and into the freezer compartment (not shown) to cool the freezer compartment of the refrigeration system. The air which is so passed contains moisture which condenses on the coils 44 as frost, thus necessitating a defrost cycle to clear the frost from the coils 44. The low pressure vapors are then passed through the suction line 46 to the suction accumulator 48. Dual pressure control PC4 cycles the compressor 10 in response to solenoid valve 34. PC4 is set to start the compressor when solenoid valve 34 pressure is about 25 psi and to stop the compressor when solenoid valve 34 pressure is about 5 psi.

Referring to FIG. 1 and describing the defrosting cycle of this invention, high pressure hot gas is discharged from the compressor 10 to discharge line 14 and through oil separator 16 to line 18, as described above. With solenoid valve 20 closed and solenoid valve 22 open by the defrost controls shown in FIG. 2, the hot gas passes through solenoid valve 22 to branch line 50 and to vaporizer tank 52. With bypass metering valve 54 in the open position hot gas flows through metering valve 54, branch line 56 and line 58 to the evaporator coils 44 during the defrost cycle. Since compressor 10 is pumping more gas than metering valve 54 allows to flow through it, the gas temperature and pressure rises in the vaporizer tank 52 and line 50. Referring to FIG. 3, pressure control sensor PC1 and pressure gage 60 notes the rise pressure and sends a signal to solenoid valve 62 to open. Solenoid valve 62 is positioned in branch line 72 which extends from vaporizer tank 52 to line 58 as shown in FIG. 1. Thus additional and higher pressure and higher temperature gas is passed to the evaporator coils 44 by way of branch line 72 and line 58. This higher pressure and temperature gas speeds up the defrosting of frost from the evaporator coils 44. Solenoid valve 62 is opened when pressure control sensor PC1 senses a pressure of about 225 psi and closes when PC1 senses a pressure of about 125 psi.

During the cooling cycle, thermostatic expansion valve 36 regulates the rate of refrigerant flow into the evaporator 42 in proportion to the rate of evaporation of the refrigerant in the evaporator. In order to do so an equalizer line 66 extends from the line 46 near the exit of the evaporator 42 to thermostatic expansion valve 36. In addition an external thermostatic bulb 68 is strapped to line 46 and a capillary tube 70 extends to thermostatic valve 36 to monitor the temperature of the refrigerant leaving the evaporator 42.

During the defrost cycle and referring to FIG. 4, if the pressure sensed by pressure control sensor PC2 is below about 40 psi at a low ambient temperature of about 50 degrees F, pressure control sensor PC2 will send a signal to open solenoid valve allowing some refrigerant to flow through thermostatical expansion valve 36. Generally the defrost cycle is terminated by defrost time and temperature controls (not shown), however if the pressure control valve PC3 in suction line 12 indicates that the pressure is too high in the compressor suction line 12, pressure control PC3 will send a signal to the defrost time and temperature control (not shown) to end the defrosting cycle and to begin the cooling cycle.

At such time, defrost time and temperature controls also send signals to close solenoid valve 22 and open solenoid valve 20. Pressure control PC4 is a dual pressure control to cycle compressor with a high pressure cutoff. Valve 64 is a safety control valve which is set to release any excess buildup of pressure in line 56.

A refrigeration system provided according to this invention operated satisfactorily and provided a freezer compartment temperature of about 28 degrees F. The compressor and condenser were mounted outside where the ambient temperature, i.e. the outside temperature, varied from about 95 degrees F to about 0 degrees F. The compressor was a 10 HP, Freon 22, semi-hermetic discus type. During cooling the compressor suction pressure was about 35 psi and the discharge pressure was about 210 psi.

The system provided for a defrost cycle about every 6 hours with the length of the defrost cycle varying from 12 to 22 minutes depending on the amount of frost buildup on the evaporator coils.

All of the various components of the refrigeration system, i.e. the compressor, oil separator, condenser, receiver tank, evaporator, accumulator, vaporizer tank, pressure control sensors, solenoid valves, safety control valve, pressure gauge, thermostatic expansion valve, metering valve, are all off the shelf items well known to persons knowledgeable in refrigeration.

I claim:

1. In a refrigeration system, a compressor, condenser, a receiver tank, evaporator, accumulator, a hot gas line from the high side of the compressor to the condenser, suction line from the evaporator to the accumulator and to the compressor, a liquid line from the condenser to the receiver tank and from the receiver tank to the evaporator, thermostatic expansion valve in the liquid line between the receiver tank and the evaporator, a first solenoid valve in said liquid line between said receiver tank and said thermostatic expansion valve, a second solenoid valve in said hot gas line, which is open during the cooling cycle of the system and closed during the defrost cycle, means to defrost the evaporator coils of said evaporator comprising (a) a first branch line connected to said hot gas line between said compressor and said second solenoid valve and extending to a vaporizer tank, (b) a third solenoid valve in said first branch line which is open during the defrost cycle of the system and closed during the cooling cycle, (c) first pressure sensing means in said first branch line between said vaporizer tank and said third solenoid valve, (d) a second branch line from said vaporizer tank to said evaporator, (e) a fourth solenoid valve in said second branch line which is closed during the start of the defrost cycle and thereafter opened in response to a rise in pressure sensed by said first pressure sensing means, (f) a third branch line from said vaporizer tank to said evaporator, and (g) a metering valve in said third branch line which remains open during the defrost cycle.

2. The refrigeration system of claim 1 further comprising means responsive to the pressure in said suction line to open said first solenoid valve during said defrost cycle to allow refrigerant to flow through said thermostatic expansion valve to said evaporator.

3. A method of defrosting evaporator coils of an evaporator of a refrigeration system comprising (a) supplying hot refrigerant gas to a vaporizer tank by a compressor, (b) continuously passing hot refrigerant gas from said vaporizer tank through a metering valve to said evaporator coils, and (c) passing additional hot refrigerant gas from said vaporizer tank through a normally closed solenoid valve when said normally closed solenoid valve is opened in response to an increase in pressure in said vaporizer tank.

4. The method of claim 3 further comprising (d) supplying refrigerant from a receiver tank in the cooling circuit of said refrigeration system to said evaporator coils when the pressure in the suction line to said compressor is below about 40 psi and the ambient temperature is below about 50 degrees F.

* * * * *